United States Patent [19]

Kolpin

[11] Patent Number: 5,028,837

[45] Date of Patent: Jul. 2, 1991

[54] LOW ENERGY ION TRAP

[75] Inventor: Hans J. Kolpin, White Lake, Canada

[73] Assignee: Atomic Energy of Canada Limited, Ottawa, Canada

[21] Appl. No.: 524,060

[22] Filed: May 16, 1990

[30] Foreign Application Priority Data

May 29, 1989 [CA] Canada ..... 601265

[51] Int. Cl.[5] ..... H01J 29/84

[52] U.S. Cl. ..... 313/424; 313/432; 328/233

[58] Field of Search ..... 313/424, 432; 315/14; 328/233

[56] References Cited

U.S. PATENT DOCUMENTS

| | | | |
|---|---|---|---|
| 3,586,901 | 6/1971 | Findeisen | 313/449 X |
| 3,886,399 | 5/1975 | Symons | 328/233 X |
| 4,625,150 | 11/1986 | Rand | 313/424 X |
| 4,720,832 | 1/1988 | Deki . | |
| 4,743,794 | 5/1988 | Van Den Broek et al. | 313/424 |

*Primary Examiner*—Palmer C. DeMeo

*Attorney, Agent, or Firm*—Judy A. Erratt; George E. Fisk

[57] ABSTRACT

An ion trap for an electron beam generator consists of at least two electrically conductive elements which are in the form of a sector of a cylinder the elements being spaced apart from each other and together form a cylindrical form. Each element has end plates and a number of fins extending inwardly to the center of the cylindrical form. A recess in the form of a sector of a circle is located in each end plate and each fin adjacent to the center of the cylindrical form. These recesses form a central bore through which an electron beam from an electron gun travels, the electron beam and central bore being essentially of the same diameter. Each elements is attached to an outer envelope by an insulating element and a conductive lead is electrically connected to each element to maintain that element at a predetermined potential which deflects positive ions travelling along the beam path.

14 Claims, 2 Drawing Sheets

LOW ENERGY ION TRAP

FIELD OF THE INVENTION

The present invention relates generally to an ion trap for an electron injector system to prevent positive ion drifting into an electron gun region where those ions can be accelerated towards and impact against a cathode in the electron gun.

BACKGROUND OF THE INVENTION

In operation, an electron beam from an electron gun creates ions along its path from residual gases in the device when molecules of the gases are hit by the electron beam. Positive ions created by the electron beam can drift into the gun electrode region where they are likely to be focused by the potential of the gun electrodes, accelerated towards and impact against the cathode.

The life of a cathode in any electron injector system is restricted by evaporation and sputtering effects. If the cathode is bombarded with high energy ions, the cathode material is sputtered creating damage which limits the effective operational life of the cathode. Therefore, ion traps have been used in many systems to capture the ions before they enter into a gun electrode acceleration region. This can be done by placing a plate in the path of the ions so that the ions will collide with the plate rather than drift into the gun electrode region. In applications where the electrons must travel along the same path as the ions they have created, but in the opposite direction, the ions must be deflected onto the plate by other means such as electrostatically.

U.S. Pat. No. 4,743,794 illustrates one type of ion trap for a cathode ray tube. In this type of tube, a semiconductor cathode has an annular emitting region surrounding a central axis of the tube. A first electrode grid adjacent the cathode has an opening which extends sufficiently far from the axis to pass electrons emitted from the annular region. A further electrode, a screen grid, is located farther from the cathode and is operated at a higher potential than the first electrode forming a positive lens which converges the annular electron beam into a cross-over at approximately the area of an opening in the screen grid through which the electron beam travels. The opening in the screen grid has a smaller diameter than the annular emitting region so that any positive ions generated near the axis and pass through the opening in the screen grid would be accelerated parallel to the axis and strike the central area of the cathode. They would not strike the annular emitting region. Furthermore, positive ions which are generated farther away from the axis would be accelerated away from the axis and the opening in the screen grid. This design prevents the majority of positive ions which are generated in the tube from impacting against the annular emitting region of the cathode. The only positive ions which will strike the annular emitting region are ones generated in a small region between the cathode and the first electrode. However, these particular ions have a relatively low energy so very little damage is done to the emitting region.

U.S. Pat. No. 3,586,901 illustrates another type of ion trap to reduce the rate at which positive ions bombard electron gun cathodes. This particular ion trap contains a pair of closely spaced titanium anodes in tandem with apertures through which the electron beam from the cathode travel. The anode nearest the cathode has a smaller aperture and is operated at a higher positive potential with respect to the cathode than the other anode. This creates a potential hill and each positive ion formed outside the region between the cathode and anodes would have to overcome that hill in order to be attracted to the cathode.

U.S. Pat. No. 4,720,832 describes another type of device to prevent impurity ions from contaminating an optical window in a laser. The device in this U.S. Patent comprises pairs of magnets on each side of the optical axis which apply magnetic fields to charged particles moving along the axis towards the window so as to deflect them away from the axis. A number of annular disks with openings along the axis, are spaced from the magnets so that the deflected charged particles are deposited onto the annular disks.

SUMMARY OF THE INVENTION

It is an object of the present invention to provide an improved and effective ion trap to prevent ions created by an electron beam in an electron injector system from entering the acceleration region of an electron gun for the system.

It is a further object of the invention to provide an ion trap which may be effectively self-excited by the electron beam passing through it.

It is still a further object of the invention to provide an ion trap which is capable of capturing a large range of low energy ions.

According to the present invention, the ion trap consists of at least two elements which are in the form of a sector of a cylinder, the elements being spaced from each other and together forming a cylindrical form, each element having end plates and a number of fins extending inwardly substantially parallel to the end plates to the cylindrical form's center, a recess in the form of a sector of a circle being located in the end plates and fins adjacent to said center forming a central bore through which an electron beam from an electron gun travels, the elements being electrically conductive and attached to an outer envelope by an insulating element with a conductive lead being electrically connected to each element to maintain that element at a predetermined potential.

In a preferred embodiment of the invention, the central bore is essentially of the same diameter as the electron beam.

In a further preferred embodiment of the invention; the number of elements is two with each having a semi-cylindrical structure.

In another embodiment of the invention, the number of elements is four with each in the form of a quarter of a cylindrical structure wherein the voltage of each sector is held at a different potential.

BRIEF DESCRIPTION OF THE DRAWINGS

The present invention will now be described in more detail with reference to the accompanying drawings, in which.

DETAILED DESCRIPTION OF THE PREFERRED EMBODIMENT

Figure 1:
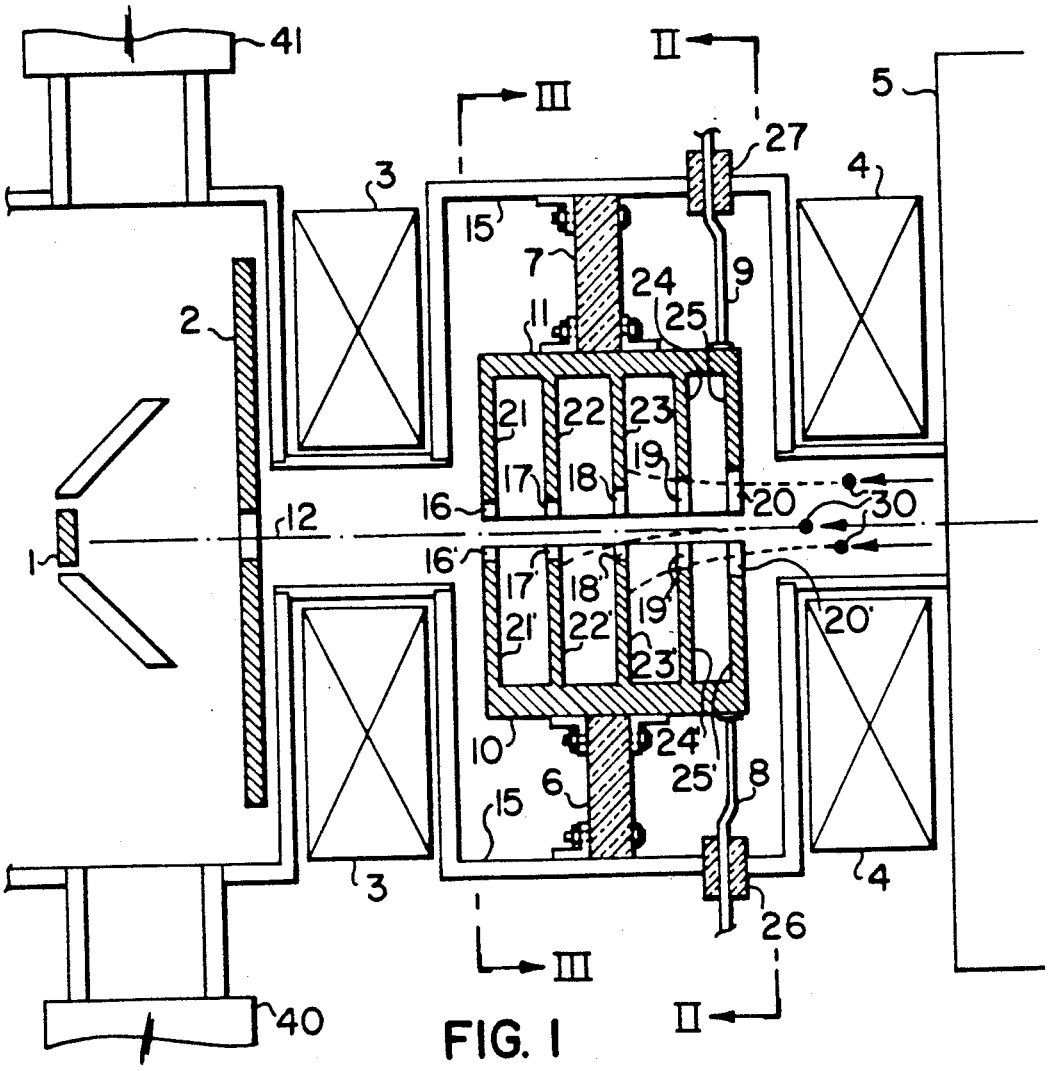
FIG. 1 is a diagram of a preferred embodiment of an electron beam device with an improved ion trap according to the present invention.
Figure 3:
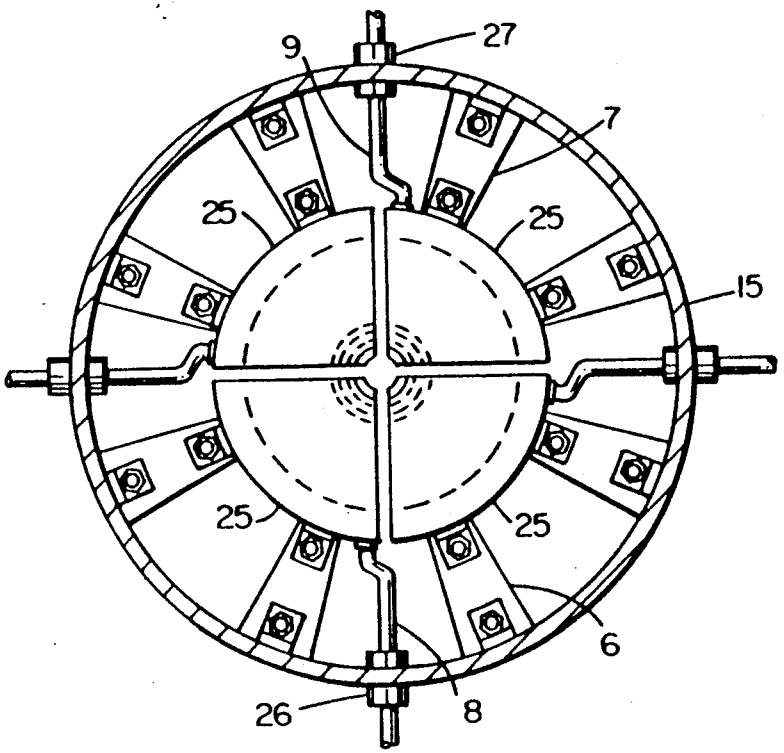
FIG. 3 also shows an end view of the end plates 25 drawn along the line III of FIG. 1. This Figure illustrates a four quadrant design.
Figure 2:
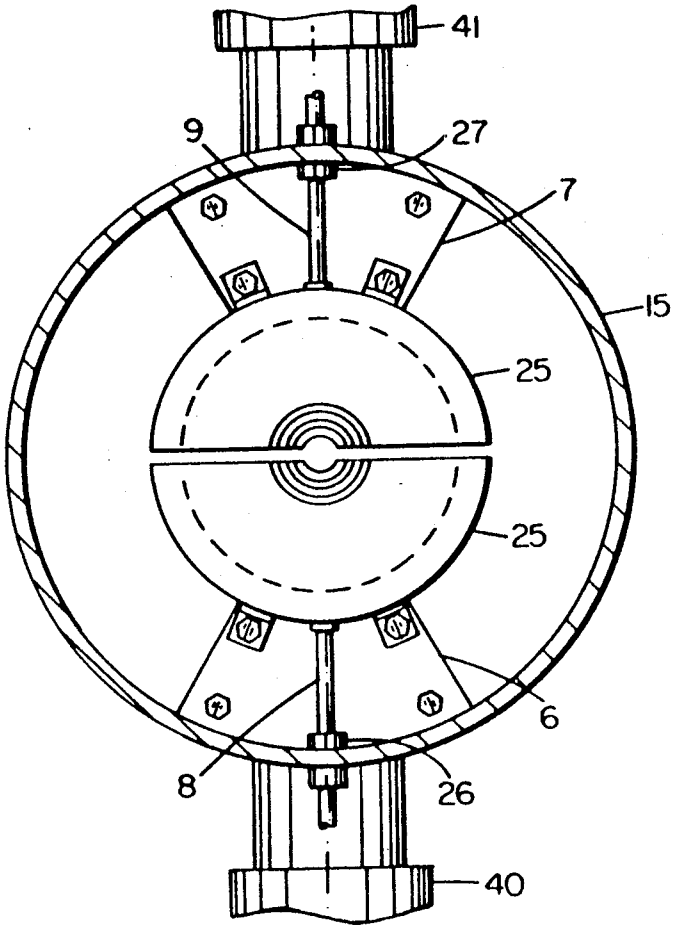
FIG. 2 shows an end view of end plate 25 shown along the line II. This Figure shows a two-half design.

An electron beam, in the device shown in FIG. 1, is generated by a cathode 1 and accelerated by an anode 2 along a center-line 12 towards an accelerator 5. The electron beam is focussed by coils 3 and 4 with an ion trap being located between the coils. The ion trap consists of two semicylindrical elements 10 and 11 which are spaced apart and are insulated from each other. The semicylindrical elements 10 and 11 have central semicircular openings in their facing sides which openings form a central bore which surrounds the center-line 12 along which the electron beam travels. Element 10 is attached to support 15 by an insulating ceramic standoff 6 while element 11 is attached to the support 15 by an insulating ceramic standoff 7. Support 15 may be a part of the outer envelope for the device.

Each semicylindrical element is formed of titanium and has a number of inwardly extending fins to create a baffle. Element 11 has an end plate 21 which is closest to the cathode and another end plate 25 at its opposite end.

Inwardly extending fins 22, 23 and 24 are located between end plates 21 and 25. In a similar manner, element 10 has end plates 21' and 25' and intermediate fins 22', 23' and 24'. Each of the fins and plates are provided with a central semicircular recess on their inner edges which co-operate together to form said central bore. The semicircular recesses 16, 16', 17 and 17' in end plate 21 (21') and the adjacent fin 22 (22') are of the same size and have flat inner edges which are parallel to the axis. However, the next fin 23 (23') has a slightly larger central recess 18 (18') with the next fin 24 (24') having a still slightly larger central recess 19 (19') and the central recess 20 (20') in end plate 25 (25') being even larger. These last-mentioned central recesses do not form a cylindrical central bore, as the ones in 21 (21') and 22 (22') do, but form a central bore which has a slightly conical shape. The base of the conical shape is located at a position which is most remote from the cathode. The inner edges of the openings in fins 23 (23'), 24 (24') and end plates 25 (25') are sloped so that they are parallel to the surface of the conical shape which has a taper of about 7°.

The inside diameter of the central bore formed by end plates 21 (21') and fin 22 (22') is dimensioned so that slight beam scraping takes place. Elements 10 and 11 are insulated by insulators 6 and 7 respectively. The elements 10 and 11 will be charged up by electrons in the beam due to beam scraping. To hold the trap element 10 at approximately −1400 volts, an appropriate bleed resistor and spark gap are connected between element 10 and ground by an electrical lead 8. When the beam is turned off element 10 will discharge slowly through the bleed resistor and will remain functional to same degree for some time. Therefore, with a negative charge on element 10, positive ions 30 which are drifting towards cathode 1 will have their trajectories altered as shown in FIG. 1. The second element 11 of the trap can be connected to ground by lead 9 or through a second bleed resistor and spark-gap if it is desired to keep element 11 at a certain potential such as −200 volts. In the latter case, positive ions which come in close proximity to the second element 11 will also collide with one of the titanium baffles in element 11. Leads 8 and 9 are electrically insulated from support 15 by insulators 26 and 27 respectively.

The ion trap can also be sectioned off into more elements than 2. For instance, the ion trap could consist of 4 quarter section elements which may be placed at difference potentials. This would then result in a greater range of low energy ions which can be trapped.

The bore diameter throughout and the ion trap are together designed to form a single stage of differential pumping system. The entrance bore for the electron beam must be carefully matched to the diameter of the particular electron beam. However, the degree of beam scraping by end plate 21 and fin 22 can be adjusted using the focus coil 3. When the system is one in which beam scraping is not desired, a high voltage power supply can be connected to lead 8 to maintain the required potential on element 10.

Ions pumps 40 and 41 are situated near the cathode and help maintain the number of gas molecules at that area to a low value.

Various modifications may be made to the preferred embodiment without departing from the spirit and scope of the invention as defined in the appended claims.

I claim

1. An ion trap for an electron beam generator consisting of at least two electrically conductive elements which are in the form of a sector of a cylinder, the elements being spaced from each other and together forming a cylindrical form, each element having end plates and a number of fins extending inwardly substantially parallel to the end plates to the cylindrical form's center, a recess in the form of a sector of a circle being located in each of the end plates and fins adjacent to said center forming a central bore through which an electron beam from an electron gun travels; the elements being attached to an outer envelope by insulating elements with a conductive lead being electrically connected to each element to maintain that element at a predetermined potential and wherein said central bore is essentially of the same diameter as the electron beam.

2. An ion trap as defined in claim 1, wherein the end plates closest to the electron gun and the fins adjacent to those end plates have a recess of identical size forming a cylindrical central bore, the recesses in the other fins and other end plates increasing slightly in size with the smallest being closest to the electron gun and the largest size recess being in the end plates which are most remote from the electron gun forming a conical central bore with a slight taper, the conical central bore having a base located at the end plates which are most remote from the electron gun.

3. An ion trap as defined in claim 2, wherein the taper of the conical central bore is about 7°.

4. An ion trap as defined in claim 3, wherein inner edges formed by the recesses in the end plates closest to the electron gun and the adjacent fins are parallel to the central axis and inner edges formed by the recesses in the other fins and end plates are sloped to be parallel to said taper.

5. An ion trap as defined in claim 4, wherein the cylindrical bore has a diameter slightly smaller than the electron beam at that location so that the outer edges of the beam scrape against the inner edges to charge up the elements, the conductive lead to at least one element being connected through a bleed resistor and air gap to ground to maintain that element at a predetermined potential.

6. An ion trap as defined in claim 4, wherein the cylindrical bore has a diameter slightly larger than the electron beam at that location and the conductive lead to at least one element is connected to a high voltage source to maintain the associated element at a predetermined voltage.

7. An ion trap as defined in claim 5, wherein the elements including the end plates and fins are formed of titanium.

8. An ion as defined in claim 6, wherein the elements including the end plates and fins are formed of titanium.

9. An ion trap as defined in claim 5, wherein said elements are two in number and the elements are semicylindrical.

10. An ion trap as defined in claim 5, wherein said elements are four in number and the elements are in the form of a quarter section of a cylinder, the leads to the elements being maintained at different predetermined potentials.

11. An ion trap as defined in claim 5, wherein the conductive lead to at least one other element is connected to ground.

12. An ion trap as defined in claim 6, wherein said elements are two in number and the elements are semicylindrical.

13. An ion trap as defined in claim 6, wherein said elements are four in number and the elements are in the form of a quarter section of a cylinder the leads to the elements being maintained at different predetermined potentials.

14. An ion trap as defined in claim 6, wherein the conductive lead to at least one other element is connected to ground.

* * * * *